US008298010B2

(12) United States Patent
Matsumoto

(10) Patent No.: US 8,298,010 B2
(45) Date of Patent: Oct. 30, 2012

(54) CONNECTOR

(75) Inventor: Masakazu Matsumoto, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 244 days.

(21) Appl. No.: 12/802,330

(22) Filed: Jun. 4, 2010

(65) Prior Publication Data

US 2011/0021073 A1 Jan. 27, 2011

(30) Foreign Application Priority Data

Jul. 22, 2009 (JP) ..... 2009-171404

(51) Int. Cl.
*H01R 9/05* (2006.01)

(52) U.S. Cl. ..... 439/582

(58) Field of Classification Search ..... 439/582, 439/63

See application file for complete search history.

(56) References Cited

U.S. PATENT DOCUMENTS

| | | | | |
|---|---|---|---|---|
| 6,503,100 | B2 * | 1/2003 | Yamane | 439/582 |
| 7,186,142 | B2 | 3/2007 | Nagata et al. | |
| 7,367,840 | B2 * | 5/2008 | Chen et al. | 439/581 |
| 7,806,726 | B2 * | 10/2010 | Chen et al. | 439/582 |
| 7,833,054 | B2 * | 11/2010 | Matsumoto | 439/582 |
| 7,938,681 | B2 * | 5/2011 | Lee et al. | 439/582 |

FOREIGN PATENT DOCUMENTS

JP 2005-310515 11/2005

* cited by examiner

*Primary Examiner* — Xuong Chung Trans
(74) *Attorney, Agent, or Firm* — Collard & Roe, P.C.

(57) ABSTRACT

A connector includes a conductive member having a mating portion that is matable with a mating connector in a first direction. The mating portion includes a first part having a first end and a second part having a second end opposed to the first end in a second direction perpendicular to the first direction so as to form an annular portion. The first end and the second end form an opposed-end portion in which one of the first end and the second end is brought into contact with another of the first end and the second end to receive a force applied to the mating portion in a diagonal direction oblique to the first direction.

8 Claims, 10 Drawing Sheets

CONNECTOR

CROSS REFERENCE TO RELATED APPLICATIONS

Applicant claims priority under 35 U.S.C. §119 of Japanese Patent Application No. JP2009-171404 filed Jul. 22, 2009.

BACKGROUND OF THE INVENTION

The present invention relates to a connector, and more particularly to a right-angle type connector.

For example, this type of connector is disclosed in JP-A 2005-310515. The connector disclosed in JP-A 2005-310515 has a contact connected to an inner conductor of a coaxial cable, a holder for holding the contact, and a conductive member including a mating portion arranged outside of the holder.

As shown in FIG. 4 of JP-A 2005-310515, the conductive member is produced by bending a blank that has been cut out of a single sheet metal. The conductive member has a base including a cable holder for holding the coaxial cable and a mating portion including an annular portion matable with a mating connector (receptacle). The cable holder holds the coaxial cable in a state in which the coaxial cable extends in a first direction. When the blank is bent, the mating portion rises from an end of the base in the first direction toward a second direction perpendicular to the first direction. Then the mating portion is pushed down toward the base (e.g., see FIG. 5 of JP-A 2005-310515). Specifically, the conductive member of JP-A 2005-310515 is produced by forming the blank, then forming the base and the mating portion in a state such that the base and the mating portion are substantially perpendicular to each other, and applying a pressure to the mating portion so as to bend and push down the mating portion toward the base.

If the connector of JP-A 2005-310515 is reduced in size, the annular portion or the like may be deformed by a pressure applied to the mating portion to push down the mating portion toward the base during the bending process of the conductive member. Additionally, the annular portion may be deformed when the connector is to be mated with the mating connector.

SUMMARY OF THE INVENTION

It is, therefore, an object of the present invention to provide a connector which has a conductive member matable with a mating connector without deformation of an annular portion and can reduce the possibility that the annular portion or the like is deformed by a pressure required to bend the conductive member.

When a conductive member having a base including a cable holder and a mating portion including an annular portion is bent, a pressure should be applied to the mating portion to push down the mating portion toward the base. If this pressure is continuously applied only in a direction perpendicular to the annular portion, no strain is produced in the mating portion including the annular portion. However, such a situation is impractical. In fact, shearing stress is applied to the mating portion to some extent due to the aforementioned pressure. The shearing stress may cause some strain to the entire mating portion including the annular portion. Therefore, some measures should be taken against such shearing stress.

Furthermore, when the connector is mated with a mating connector, a force toward the mating direction is applied to the mating portion so that the connector is mated with the mating connector. At that time, if a force is applied to the mating portion in a direction oblique to the mating direction, the mating portion may be deformed. Some measures should be taken against such a diagonal force.

In the present invention, because it is impractical to eliminate shearing stress produced in the mating portion as described above, the mating portion is provided with a structure that is resistant to the aforementioned shearing stress. Additionally, even if a force is applied to the mating portion in a direction oblique to the mating direction, the connector can receive such a force. Specifically, the present invention provides the following connector as means for solving the aforementioned drawbacks.

One aspect of the present invention provides a connector including a conductive member having a mating portion that is matable with a mating connector in a first direction. The mating portion includes a first part having a first end and a second part having a second end opposed to the first end in a second direction perpendicular to the first direction so as to form an annular portion. The first end and the second end form an opposed-end portion in which one of the first end and the second end is brought into contact with another of the first end and the second end to receive a force applied to the mating portion in a diagonal direction oblique to the first direction.

An appreciation of the objectives of the present invention and a more complete understanding of its structure may be had by studying the following description of the preferred embodiment and by referring to the accompanying drawings.

Figure 1:
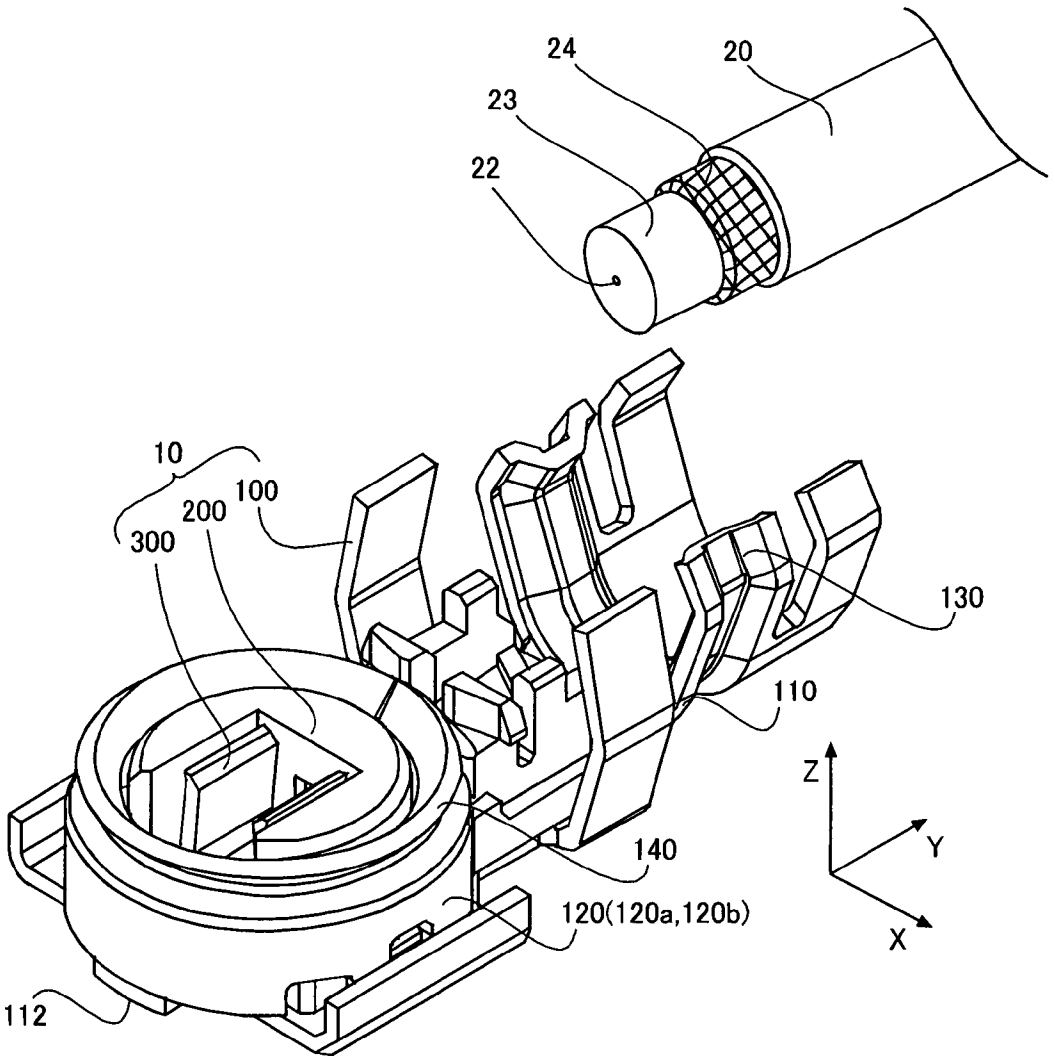
FIG. 1 is a perspective view showing a connector according to an embodiment of the present invention and a coaxial cable.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 2:
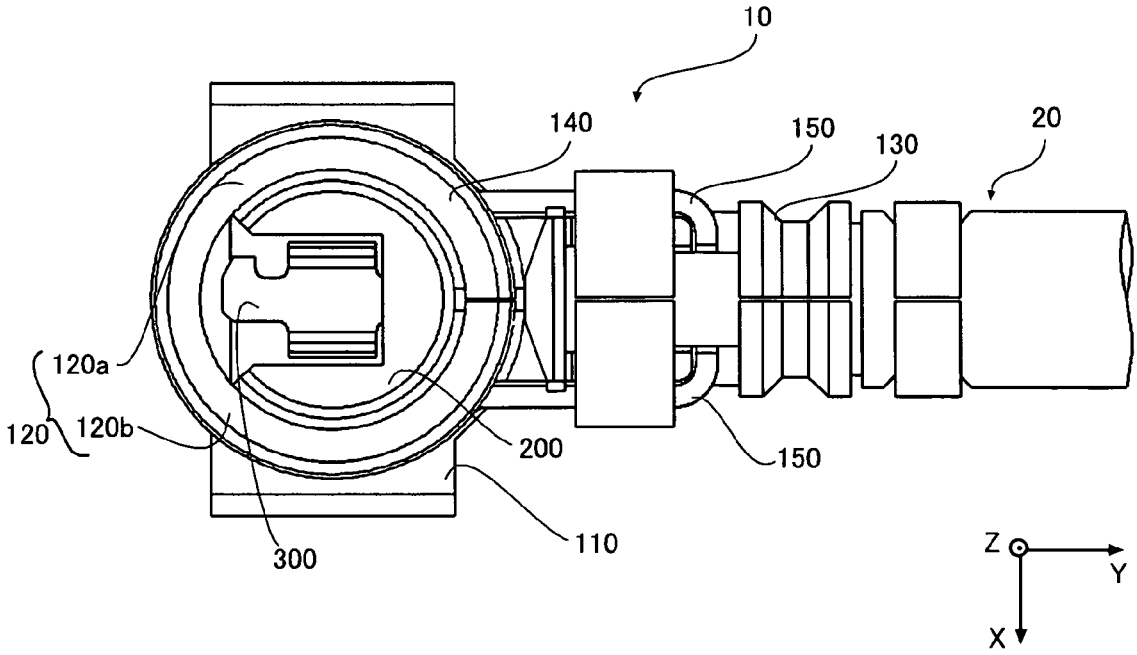
FIG. 2 is a view showing that the coaxial cable has been connected to the connector of FIG. 1.

As shown in FIGS. 1 and 2, a coaxial cable 20 extending along the Y-direction is connected to a connector 10 according to an embodiment of the present invention. The connector 10 has a conductive member 100, a holder 200 incorporated in the conductive member 100, and a contact 300 held by the holder 200. The conductive member 100 includes a base 110 extending along the Y-direction, a bent portion 112 located at an end of the base 110 in the Y-direction, and a mating portion 120 connected continuously to the bent portion 112. The base 110 has a cable holder 130 formed for holding the coaxial cable 20. The coaxial cable 20 is connected to the connector 10 in a state in which it is held by the cable holder 130. The mating portion 120 includes a first part 120*a* and a second part 120*b* so as to form an annular portion 140. The annular portion 140 is mated with a mating connector (not shown) in the Z-direction (first direction). In other words, the mating direction of the mating connector is the same as a direction along an axis passing through the center of the annular shape of the annular portion 140 (the Z-direction in FIG. 1).

Figure 3:
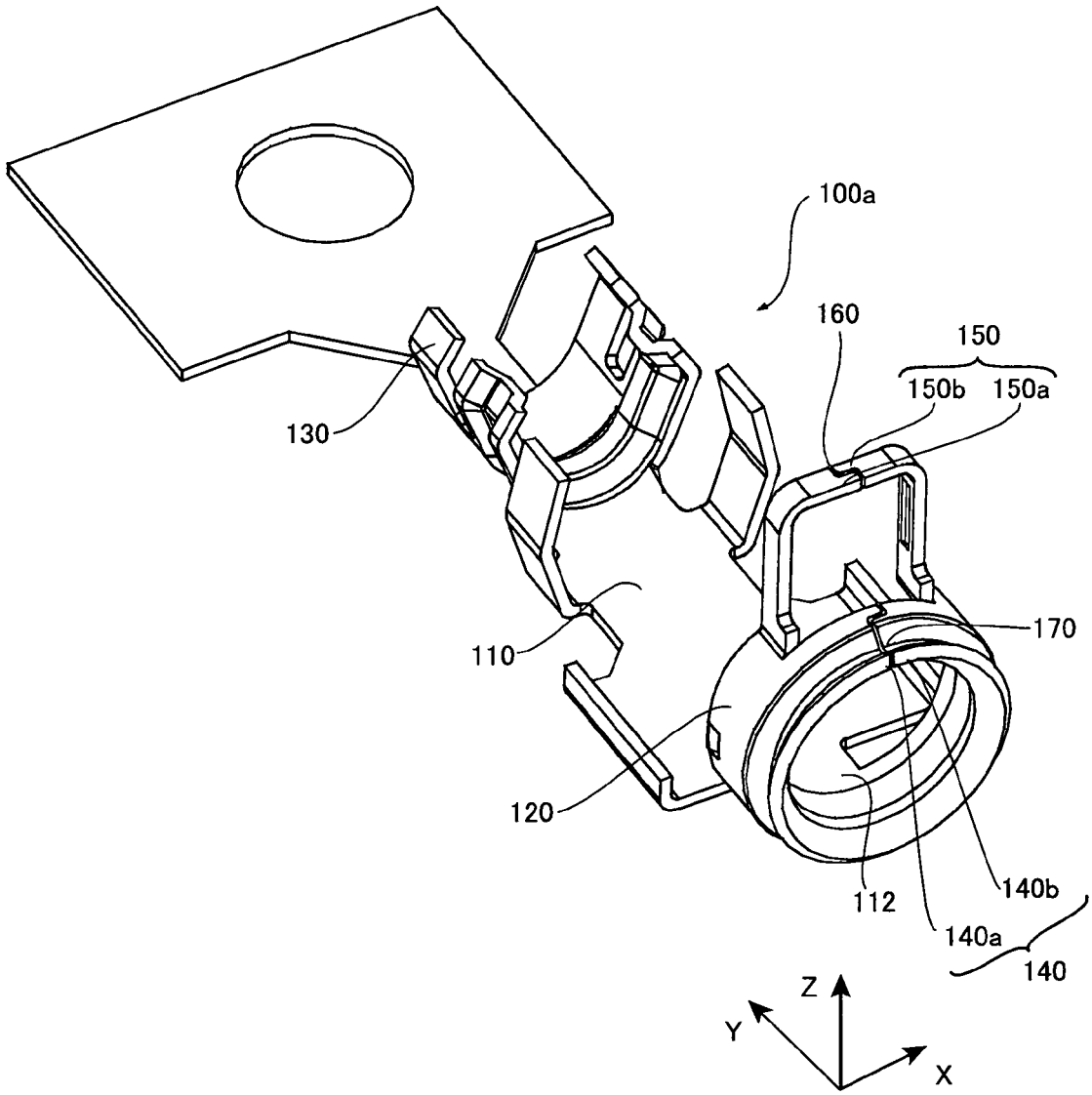
FIG. 3 is a perspective view showing a primary product to form a conductive member used for the connector shown in FIG. 1.

The conductive member 100 according to the present embodiment is produced by pressing a single sheet metal to form a primary product 100*a* shown in FIG. 3 and then pushing down the mating portion 120 toward the base 110. The pressed sheet metal has extensions extending along the X-direction (second direction) at its ends in the Y-direction (third direction). Specifically, the extensions include a first extension extending toward the positive X-direction and a second extension extending toward the negative X-direction. Each of the first extension and the second extension has an end, which will be described later. The first extension and the second extension correspond to a first part, which includes an end 140*a*, and a second part, which includes another end 140*b* of the annular portion 140 (see FIG. 3). The primary product 100*a* shown in FIG. 3 is formed by pressing the sheet metal such that the ends of the two extensions are opposed to each other.

In the present embodiment, there are two opposed-end portions in which corresponding ends are opposed to each other. Specifically, as shown in FIG. 3, the primary product 100*a* includes a first opposed-end portion 160 formed by ends 150*a* and 150*b* of L-shaped arm portions 150, which extend from the annular portion 140, and a second opposed-end portion 170 formed by the end 140*a* of the first part and the end 140*b* of the second part of the annular portion 140. The arm portions 150 according to the present embodiment have a hook-shape as a whole when the first opposed-end portion 160 is formed.

Figure 4:
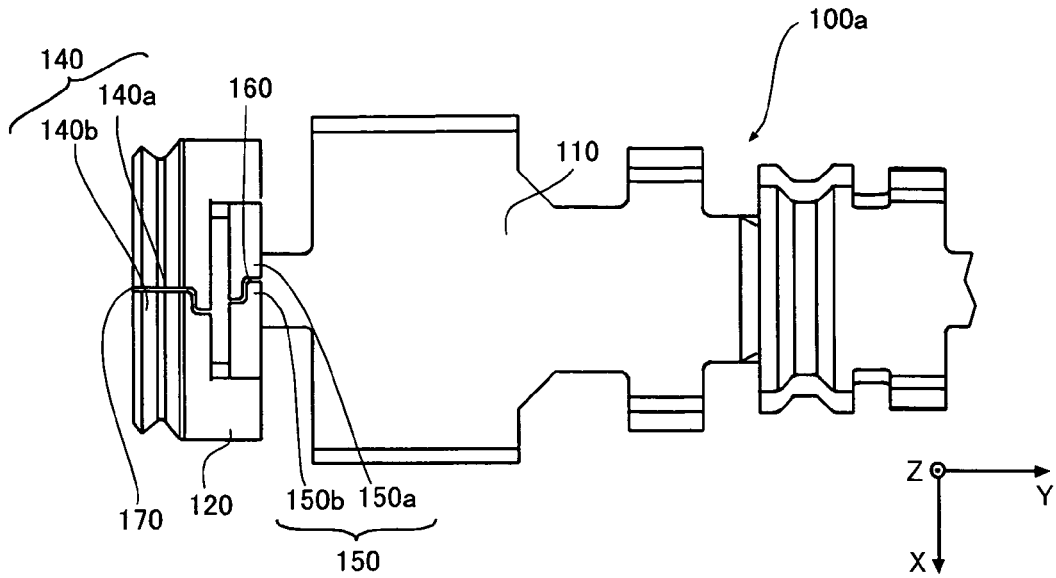
FIG. 4 is a plan view of the primary product shown in FIG. 3.
Figure 5:
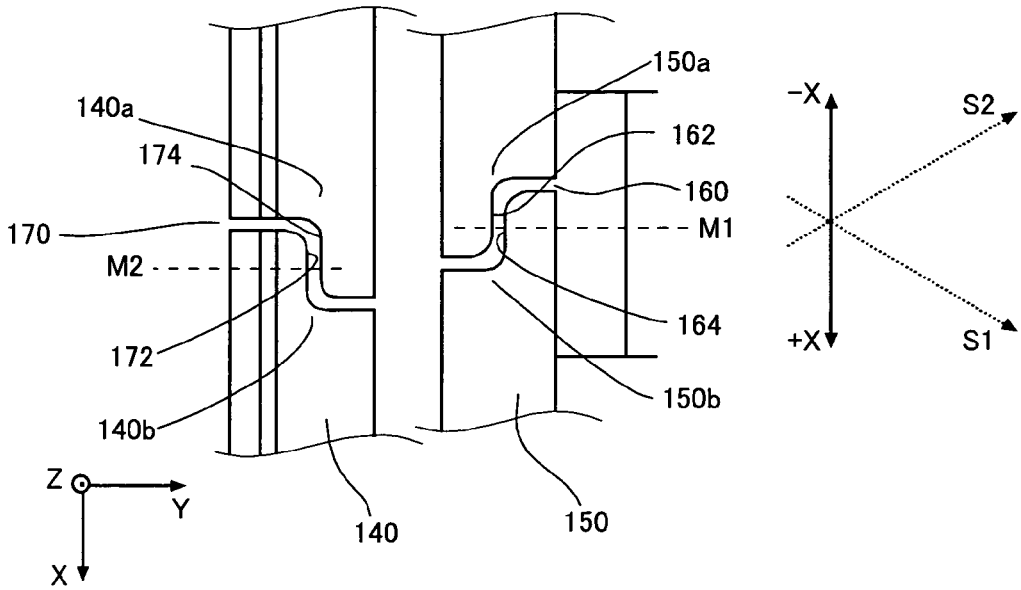
FIG. 5 is a partial enlarged view showing a first opposed-end portion and a second opposed-end portion of the primary product shown in FIG. 4.

In the present embodiment, as shown in FIGS. 3 and 4, the ends 150*a* and 150*b* of the arm portions 150, which form the first opposed-end portion 160, are designed to have shapes corresponding to each other. Similarly, the ends 140*a* and 140*b* of the annular portion 140, which form the second opposed-end portion 170, are designed to have shapes corresponding to each other. Specifically, as shown in FIG. 5, the two ends 150*a* and 150*b* of the arm portions 150, which form the first opposed-end portion 160, have a receiver edge 164 and a counter edge 162, respectively. Similarly, the ends 140*b* and 140*a* of the annular portion 140, which form the second opposed-end portion 170, have a receiver edge 174 and a counter edge 172, respectively. In the present embodiment, the center M1 of the first opposed-end portion 160 is deviated from the center M2 of the second opposed-end portion 170 in the X-direction. The advantages of the deviation will be described later. The first opposed-end portion 160 and the second opposed-end portion 170 are arranged so as to form cranked gaps in the first opposed-end portion 160 and the second opposed-end portion 170, respectively, as viewed along the Z-direction. The cranked gaps are configured to turn in different directions. Although each of the first opposed-end portion 160 and the second opposed-end portion 170 of the present embodiment has a gap formed therein, the first opposed-end portion 160 and the second opposed-end portion 170 may have no gap formed therein. Specifically, the ends 150*a* and 150*b* of the arm portion 150, which form the first opposed-end portion 160, may be brought into contact with each other, and the ends 140*a* and 140*b* of the annular portion 140, which form the second opposed-end portion 170, may be brought into contact with each other. In the present embodiment, as shown in FIGS. 1 and 2, the ends 140*a* and 140*b*, which form the second opposed-end portion 170, are the only ends of the annular portion 140. In other words, the gap formed by the ends 140*a* and 140*b* is the only gap formed in the annular portion 140.

Figure 6:
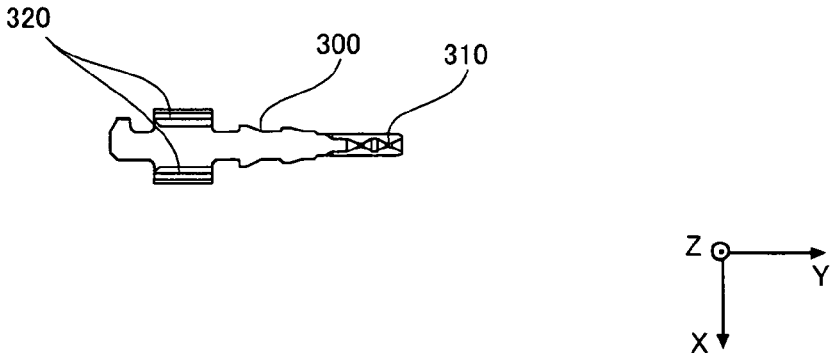
FIG. 6 is a plan view showing a contact used for the connector shown in FIG. 1.
Figure 7:
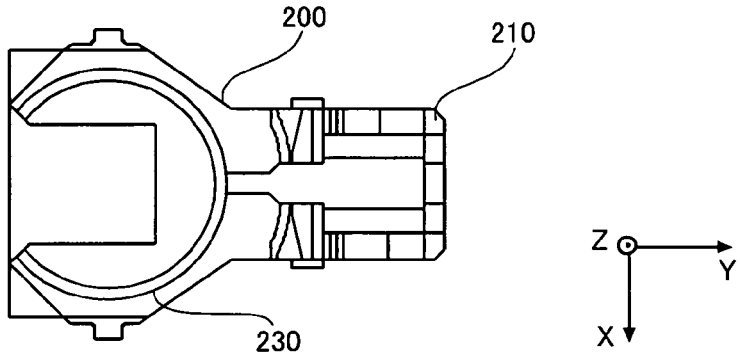
FIG. 7 is a plan view showing a holder used for the connector shown in FIG. 1.

As shown in FIG. 6, the contact 300 according to the present embodiment includes an inner conductor connection portion 310 connected to an inner conductor 22 of the coaxial cable and mating contact connection portions 320 connected to a contact of the mating connector. The inner conductor connection portion 310 of the present embodiment has a projection formed for piercing an insulator 23 of the coaxial cable to establish connection with the inner conductor 22. Furthermore, as shown in FIG. 7, the holder 200 according to the present embodiment includes an arm-side part 210 and a mating-side part 230. The arm-side part 210 is held so as to be surrounded by the arm portions 150 of the primary product 100*a*. The mating-side part 230 includes a ring-like part, which is inserted in the annular portion 140 of the conductive member 100. The holder 200 of the present embodiment is formed of an insulating material.

The connector 10 according to the present embodiment is generally produced as follows: The contact 300 is held by the holder 200. The contact 300 and the holder 200 are incorporated in the primary product 100*a*. Then the primary product 100*a* is bent to produce the connector 10. Those processes will be described in detail.

Figure 8:
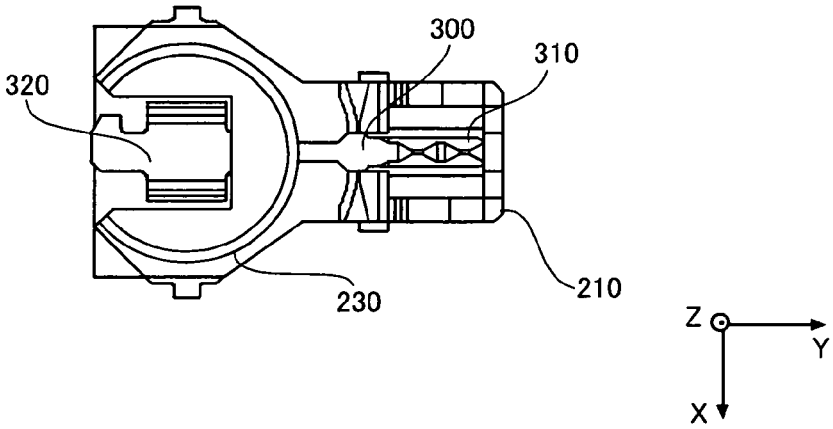
FIG. 8 is a plan view showing the contact shown in FIG. 6 and the holder shown in FIG. 7, in which the contact is held by the holder.

First, the contact 300 is inserted into the holder 200 along the Y-direction, so that the contact 300 is held by the holder 200 as shown in FIG. 8.

Figure 9:
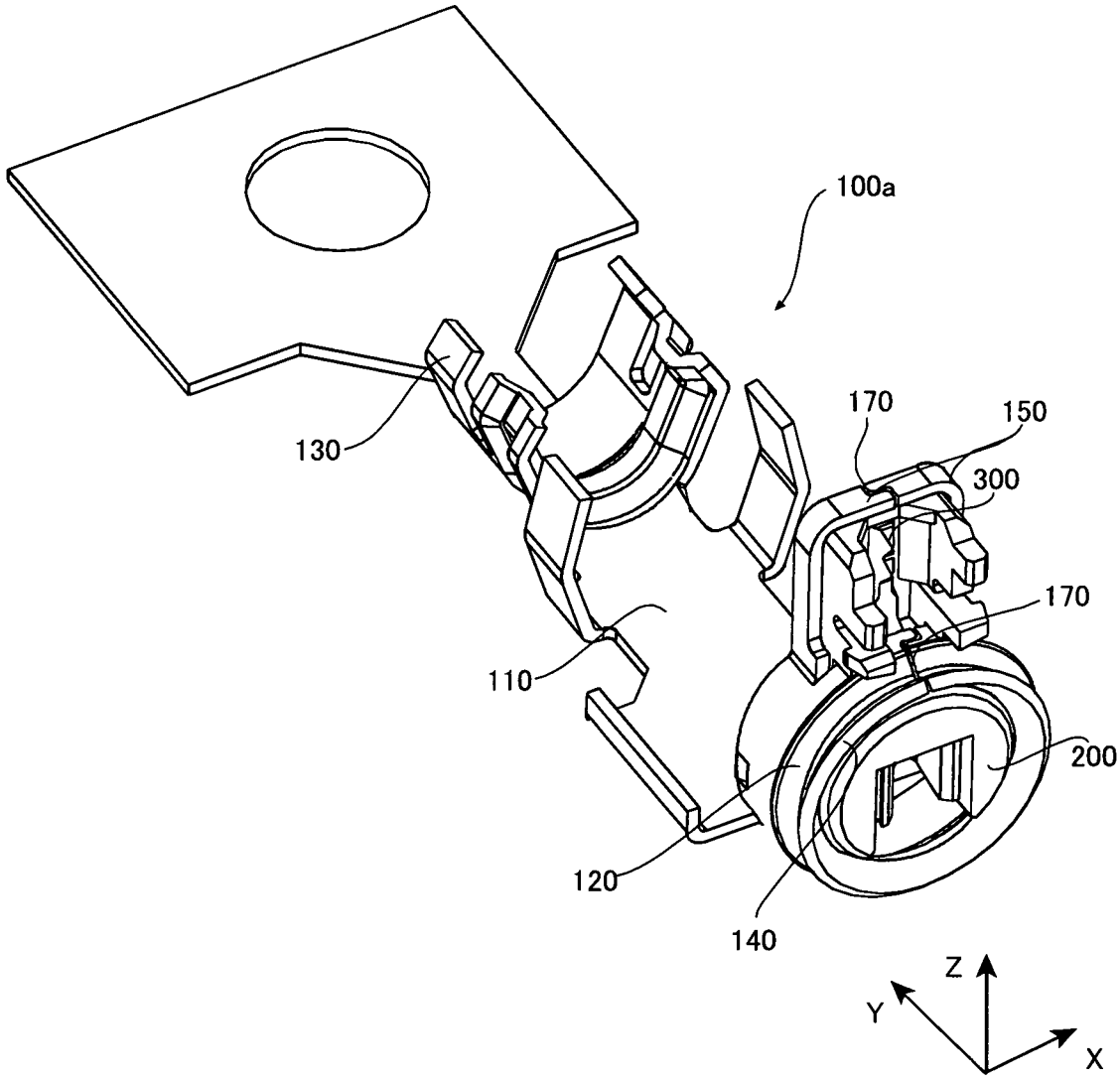
FIG. 9 is a view showing that the holder shown in FIG. 8 has been incorporated in the primary product shown in FIG. 3, in which the holder holds the contact shown in FIG. 6.
Figure 10:
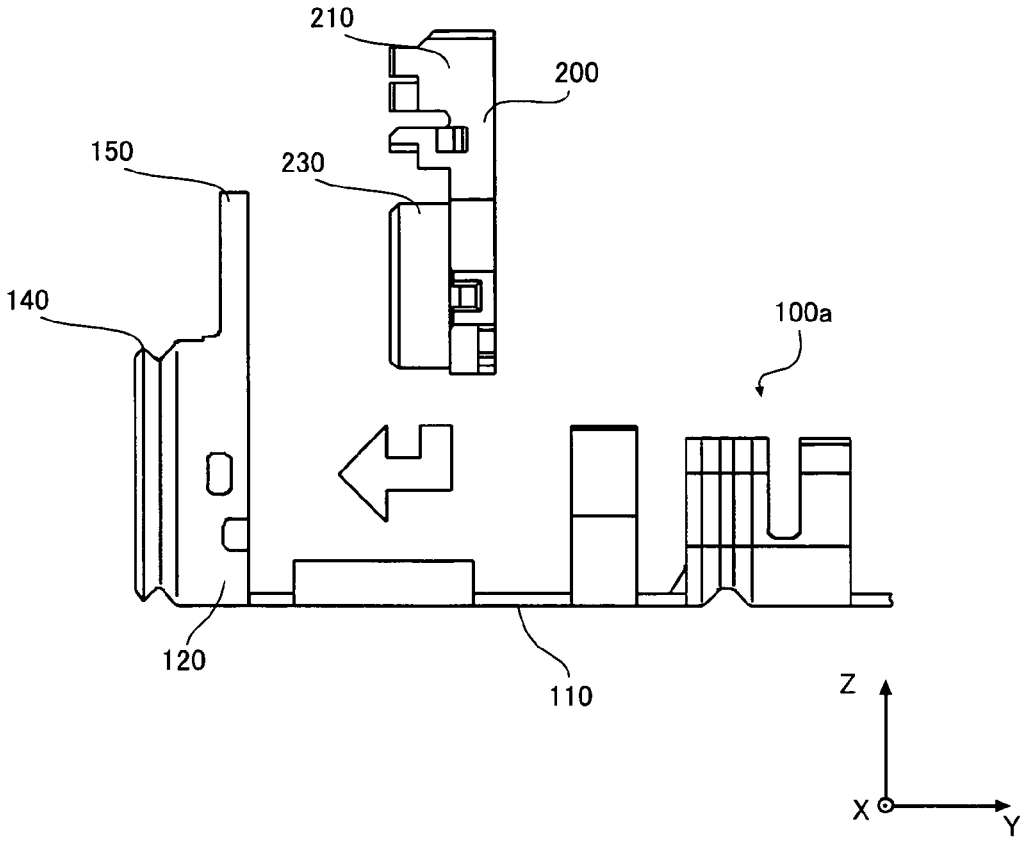
FIG. 10 is a view showing how to incorporate the holder shown in FIG. 8 into the primary product shown in FIG. 3.

Then, as shown in FIGS. 3, 9, and 10, the holder 200 holding the contact 300 is incorporated in the mating portion

120 of the primary product 100*a* by inserting the mating-side part 230 of the holder 200 into the annular portion 140 and positioning the arm-side part 210 such that the arm-side part 210 is surrounded by the arm portions 150.

Figure 11:
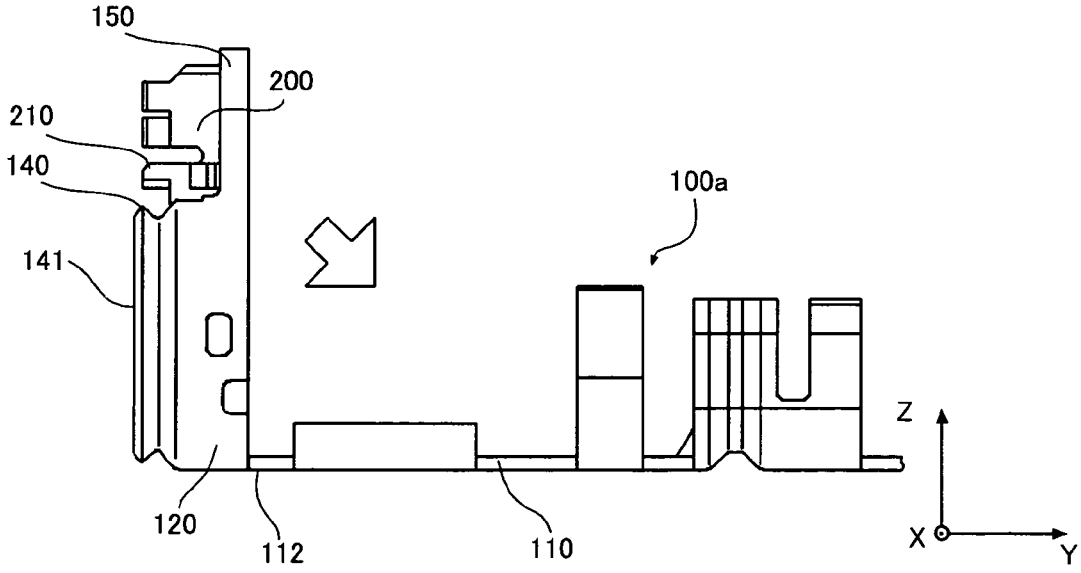
FIG. 11 is a view showing that the holder has been incorporated in the primary product shown in FIG. 3.
Figure 12:
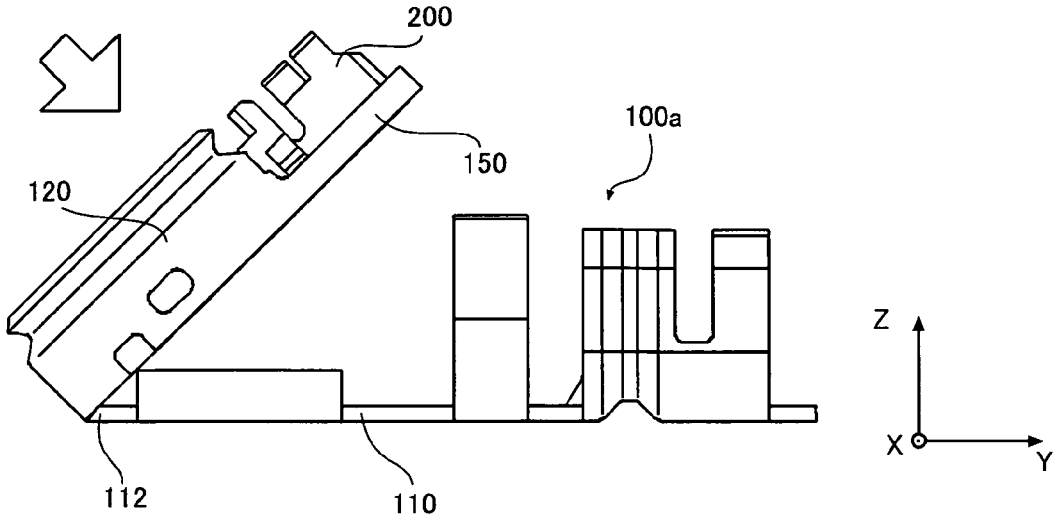
FIG. 12 is a view showing that a mating portion of the primary product of FIG. 11 is being pushed down toward a base.

After the holder 200 is incorporated in the primary product 100*a*, the primary product 100*a* is bent so that the mating portion 120 is pushed down toward the base 110. Specifically, as shown in FIG. 11, the axis of the annular portion 140 is directed toward the Y-direction at the initial state of the primary product 100*a*, so that a surface perpendicular to the axis of the annular portion 140 (mating surface) is in parallel to the XZ-plane. While the bent portion 112 is used as a fulcrum, the mating portion 120 is pushed down toward the base 110 so that the primary product 100*a* comes into a state shown in FIG. 12 and then into a state shown in FIG. 1 (i.e., until the axis of the annular portion 140 is directed toward the Z-direction so that the mating surface is in parallel to the XY-plane.)

When the mating portion 120 is pushed down toward the base 110, forces are applied to the mating portion 120 in directions perpendicular to the X-direction. Forces may concurrently be applied to the mating portion 120 in a direction that is oblique to the X-direction and is not perpendicular to the X-direction (i.e., a direction oblique to the mating surface). Such forces applied in a direction that is oblique to the X-direction and is not perpendicular to the X-direction (a direction oblique to the mating surface) are classified into two groups. One of the groups is a force having a component of the positive X-direction when the force is decomposed into a component of the X-direction and a component of a direction perpendicular to the X-direction. This type of forces is referred to as a force toward a first diagonal direction. The other of the group is a force having a component of the negative X-direction when the force is decomposed into a component of the X-direction and a component of a direction perpendicular to the X-direction. This type of forces is referred to as a force toward a second diagonal direction. In other words, when the mating portion 120 is pushed down toward the base 110, not only a force toward a direction perpendicular to the X-direction (a force toward a direction perpendicular to the mating surface) but also a force S1 toward the first diagonal direction or a force S2 toward the second diagonal direction may be applied to the mating portion 120 as shown in FIG. 5.

According to the present embodiment, when a force S1 toward the first diagonal direction is applied to the mating portion 120, the receiver edge 164 of the first opposed-end portion 160 receives the counter edge 162, thereby confronting the force S1. When a force S2 toward the second diagonal direction is applied to the mating portion 120, the receiver edge 174 of the second opposed-end portion 170 receives the counter edge 172, thereby confronting the force S2. In other words, the first opposed-end portion 160 and the second opposed-end portion 170 according to the present embodiment have such grooves that they can receive either a force S1 applied toward the first diagonal direction or a force S2 applied toward the second diagonal direction. Thus, even if shearing stress is produced when the mating portion 120 is pushed down, the mating portion 120 is prevented from being twisted laterally. Therefore, according to the present embodiment, the mating portion 120 can be pushed down toward the base 110 without deformation of the annular portion 140. In this manner, the connector 10 shown in FIG. 1 can be obtained. The aforementioned arrangement in which the center M1 of the first opposed-end portion 160 is deviated from the center M2 of the second opposed-end portion 170 allows the first opposed-end portion 160 and the second opposed-end portion 170 to effectively receive both of a force S1 toward the first diagonal direction and a force S2 toward the second diagonal direction.

Additionally, the first opposed-end portion 160 and the second opposed-end portion 170 according to the present embodiment contribute prevention of deformation of the mating portion 120 due to a force applied to the mating portion in a direction that is not parallel to the Z-direction, i.e., a direction that is oblique to the Z-direction when the annular portion 140 is mated with the mating connector.

Figure 13:
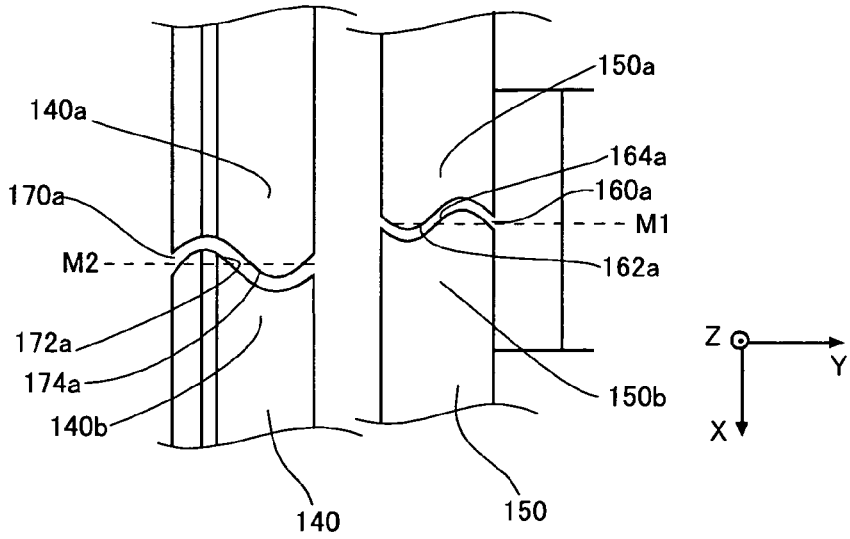
FIG. 13 is a partial enlarged view showing a variation of the first opposed-end portion and the second opposed-end portion shown in FIG. 5.
Figure 14:
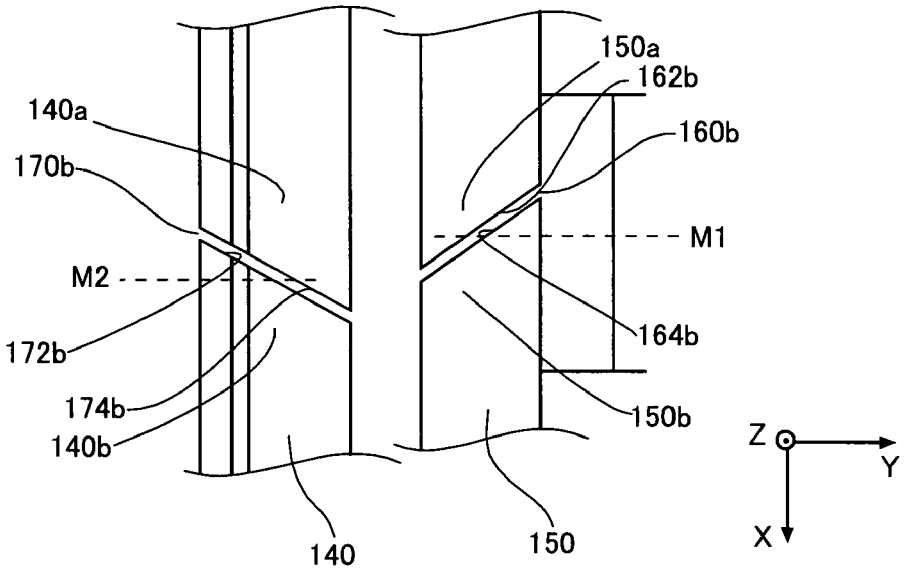
FIG. 14 is a partial enlarged view showing another variation of the first opposed-end portion and the second opposed-end portion shown in FIG. 5.
Figure 15:
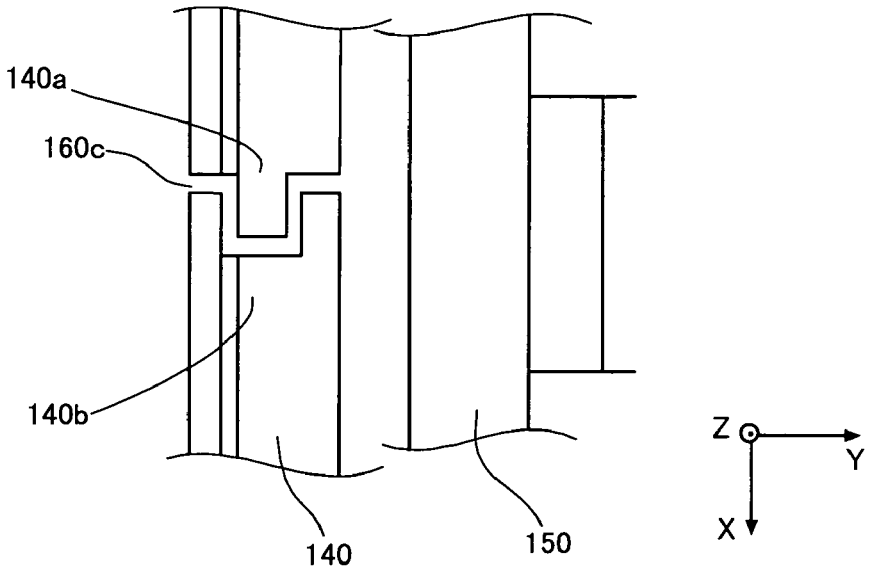
FIG. 15 is a partial enlarged view showing a variation in which the first opposed-end portion and the second opposed-end portion shown in FIG. 5 are unified into one opposed-end portion.
Figure 16:
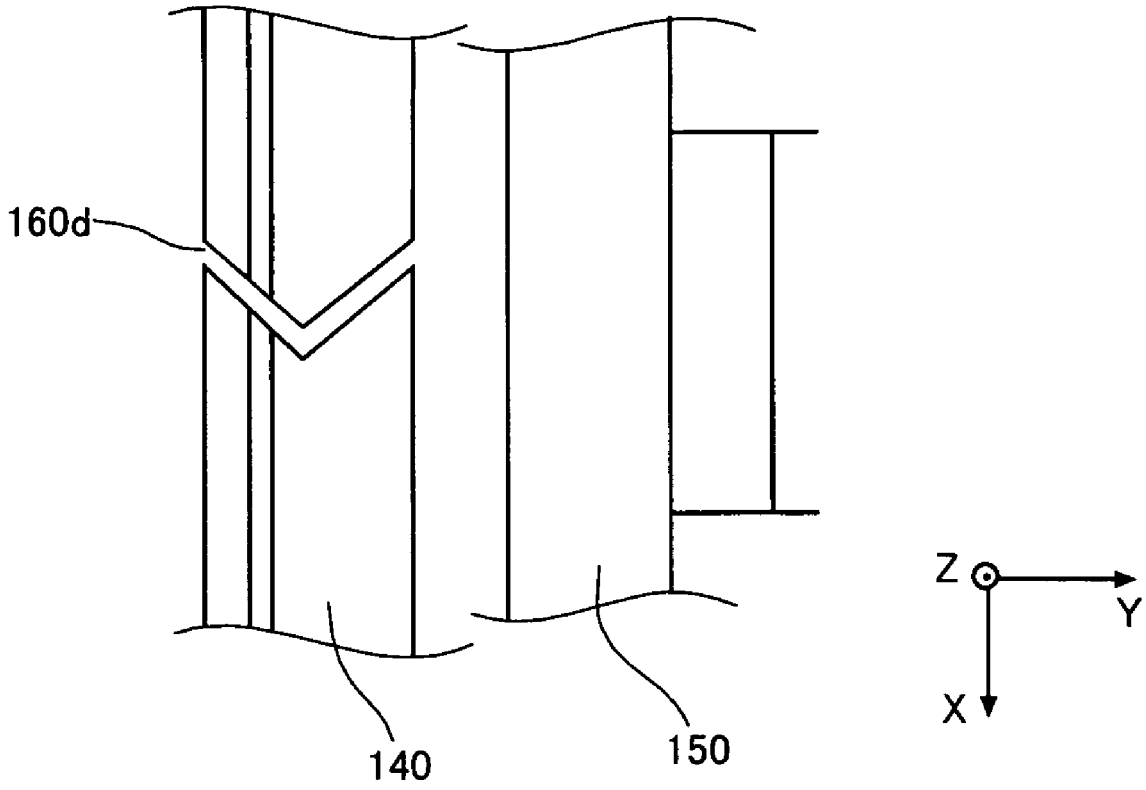
FIG. 16 is a partial enlarged view showing another variation in which the first opposed-end portion and the second opposed-end portion shown in FIG. 5 are unified into one opposed-end portion.

Each of the aforementioned first opposed-end portion 160 and second opposed-end portion 170 has ends (140*a* and 140*b*, 150*a* and 150*b*) so as to produce a cranked gap therebetween. For example, as shown in FIG. 13, a first opposed-end portion 160*a* and a second opposed-end portion 170*a* may be configured to have wavy grooves. In this case, the wavy grooves are arranged so as to curve in different directions. Furthermore, as shown in FIG. 14, a first opposed-end portion 160*b* and a second opposed-end portion 170*b* may be configured to have oblique linear grooves. In this case, the oblique linear grooves are arranged so as to extend in different directions. Additionally, as shown in FIGS. 15 and 16, the aforementioned first opposed-end portion 160 and second opposed-end portion 170 may be unified into one continuous opposed-end portion 160*c* or 160*d* in the annular portion 140 so as to receive forces applied in directions oblique to the mating direction. Furthermore, such one continuous opposed-end portion as shown in FIGS. 15 and 16 may be provided only in the arm portions 150, not in the annular portion 140.

According to the present invention, an opposed-end portion, which is formed by opposing ends of a blank during formation of a mating portion, is configured to receive forces applied to the mating portion either in a first diagonal direction or a second diagonal direction due to shearing stress produced during a process to push down the mating portion toward a base. Specifically, one edge of the opposed-end portion is brought into contact with another edge of the opposed-end portion, making it possible to receive forces applied either in a first diagonal direction or a second diagonal direction. Therefore, the possibility that an annular portion or the like is deformed by a pressure required to bend a conductive member can be reduced. Furthermore, even if a force is applied to the mating portion in a direction oblique to the mating direction during the mating process, one edge of the opposed-end portion is brought into contact with the other edge of the opposed-end portion, making it possible to receive such a force.

The present application is based on a Japanese patent application of JP2009-171404 filed before the Japan Patent Office on Jul. 22, 2009, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector comprising:

a conductive member having a mating portion matable with a mating connector in a first direction, the mating portion including a first part having a first end and a second part having a second end opposed to the first end in a second direction perpendicular to the first direction so as to form an annular portion, wherein the first end and the second end form an opposed-end portion, wherein the first end and the second end have a receiver edge and a counter edge, respectively, and wherein, even when a force is applied to the mating portion in a diagonal direction oblique to the first direction, the receiver edge receives the counter edge to reduce a possibility that the force deforms the annular portion.

2. The connector as recited in claim 1, wherein the diagonal direction is oblique to both of the first direction and the second direction on a plane defined by the first direction and the second direction.

3. The connector as recited in claim 1, wherein a primary product is formed by cutting out of a single sheet metal, followed by bending the cut-out single sheet metal, the cut-out sheet metal has extensions extending along the second direction at an end of the cut-out sheet metal in a third direction, the third direction is perpendicular to the first direction and the second direction, the primary product has a base extending along the third direction and the mating portion rising along the first direction from an end of the base in the third direction, the opposed-end portion of the mating portion of the primary product is formed by bending the extensions of the cut-out sheet metal so that ends of the extensions in the second direction are opposed to each other, the mating portion of the primary product is bent and pushed down toward the base to form the conductive member, and even if the opposed-end portion is applied with a diagonal force along a direction that is oblique to the second direction and is not perpendicular to the second direction, the receiver edge receives the counter edge to reduce a possibility that the diagonal force deforms the annular portion.

4. The connector as recited in claim 3, wherein the conductive member further includes an additional opposed-end portion independent of the opposed-end portion, the opposed-end portion is capable of confronting a force applied in a first diagonal direction that is oblique to the second direction and is not perpendicular to the second direction, and the additional opposed-end portion is capable of confronting a force applied in a second diagonal direction that is oblique to the second direction and is not perpendicular to the second direction.

5. The connector as recited in claim 4, wherein the conductive member further includes two arm portions extending from the mating portion, the mating portion has one pair of opposed ends that serve as the opposed-end portion, and the two arm portions are opposed to each other at their ends that serve as the additional opposed-end portion.

6. The connector as recited in claim 5, wherein the conductive member further has a cable holder for holding a cable having an outer conductor and an inner conductor insulated from each other, the mating portion is configured to electrically be connected to the outer conductor in a state in which the cable holder holds the cable, the connector further comprises a contact electrically connected to the inner conductor and a holder for holding the contact, each of the two arm portions extends along the third direction from the mating portion so as to form an L-shape, the two arm portions are opposed to each other so as to form a hook-shape as viewed along the first direction in a state in which the mating portion has been pushed down, and the holder is held by the base, the two arm portions, and the mating portion.

7. The connector as recited in claim 4, wherein the opposed-end portion and the additional opposed-end portion are formed by cranked grooves that turn in different directions.

8. The connector as recited in claim 4, wherein a center of the opposed-end portion is deviated from a center of the additional opposed-end portion in the second direction.

* * * * *